US010792534B2

(12) United States Patent
Klecka

(10) Patent No.: US 10,792,534 B2
(45) Date of Patent: Oct. 6, 2020

(54) USE OF FREE WEIGHTS FOR EXERCISE

(71) Applicant: James Jacob Klecka, Williston, VT (US)

(72) Inventor: James Jacob Klecka, Williston, VT (US)

( * ) Notice: Subject to any disclaimer, the term of this patent is extended or adjusted under 35 U.S.C. 154(b) by 94 days.

(21) Appl. No.: 15/984,369

(22) Filed: May 20, 2018

(65) Prior Publication Data

US 2019/0351280 A1 Nov. 21, 2019

(51) Int. Cl.
*A63B 21/00* (2006.01)
*A63B 21/072* (2006.01)

(52) U.S. Cl.
CPC ..... *A63B 21/4035* (2015.10); *A63B 21/0724* (2013.01); *A63B 21/0726* (2013.01)

(58) Field of Classification Search
CPC ..... A63B 1/00; A63B 15/00; A63B 15/005; A63B 21/0004; A63B 21/00058; A63B 21/00061; A63B 21/00065; A63B 21/00069; A63B 21/00072; A63B 21/00076; A63B 21/00185; A63B 21/0608; A63B 21/0615; A63B 21/0616; A63B 21/0617; A63B 21/0618; A63B 21/072; A63B 21/0722; A63B 21/0724; A63B 21/0726; A63B 21/0728; A63B 21/075; A63B 21/08; A63B 21/15; A63B 21/159; A63B 21/16; A63B 21/22; A63B 21/4023; A63B 21/4027; A63B 21/4033; A63B 21/4035; A63B 21/4041; A63B 21/4043; A63B 21/4045; A63B 21/4047; A63B 21/4049; A63B 22/0046; A63B 23/12; A63B 2210/00; A63B 2210/50; A63B 2225/09; A63B 2225/093; A63B 2244/09

See application file for complete search history.

(56) References Cited

U.S. PATENT DOCUMENTS 3,475,024 A * 10/1969 Lewis ..... A63B 21/0615 482/97
4,345,756 A * 8/1982 Hoagland ..... A63B 21/075 482/109
4,357,010 A 11/1982 Telle
4,527,797 A 7/1985 Slade, Jr.
4,537,394 A * 8/1985 Golinsky, Jr. ..... A63B 21/072 482/109
4,822,035 A 4/1989 Jennings et al.
5,039,091 A * 8/1991 Johnson ..... A63B 21/157 428/110
5,098,361 A * 3/1992 Danylieko ..... A63B 21/0615 482/106
5,121,925 A * 6/1992 Blundo ..... A63B 69/3632 473/242
5,135,456 A 8/1992 Jones
5,281,192 A * 1/1994 Nelson ..... A63B 15/00 482/105

(Continued)

*Primary Examiner* — Gary D Urbiel Goldner
(74) *Attorney, Agent, or Firm* — Paul Frank + Collins P.C.

(57) ABSTRACT

A weight training apparatus is configured to improve use and enjoyment of free-weights. The apparatus may leverage a modular or changeable assembly to accommodate different exercise or types of free-weight devices. The assembly may include a frame that can accommodate retainers that can secure to both a standard barbell shaft or receive plate weights. The retainers may also accommodate a handle that can rotate relative to the frame.

20 Claims, 14 Drawing Sheets

(56) References Cited

U.S. PATENT DOCUMENTS 5,435,800 A * 7/1995 Nelson ..... A63B 21/072 482/108
5,490,825 A * 2/1996 Wilkinson ..... A45B 3/00 482/109
5,628,713 A * 5/1997 Wilkinson ..... A45B 3/00 482/51
5,718,654 A 2/1998 Kennedy
5,788,608 A * 8/1998 Wilkinson ..... A63B 21/0724 482/51
5,836,858 A * 11/1998 Sharff ..... A63B 21/0724 482/106
6,663,542 B1 * 12/2003 Trabbic ..... A63B 21/0724 482/106
6,752,747 B2 * 6/2004 Yu ..... A63B 21/00043 482/110
7,476,183 B1 * 1/2009 Chrest ..... A63B 21/072 482/908
7,670,271 B2 3/2010 Finch
7,862,486 B1 1/2011 Watson
7,946,967 B2 5/2011 Berhanu
8,047,973 B2 11/2011 Berenshteyn
8,147,391 B1 * 4/2012 Hill ..... A63B 21/4035 482/132
8,556,781 B1 * 10/2013 Fitzpatrick ..... A63B 21/0724 482/106
8,979,721 B2 3/2015 Cavaliere
9,028,378 B2 * 5/2015 Shah ..... A63B 21/0624 482/109
9,126,080 B2 9/2015 Shah
9,302,142 B2 4/2016 Berry et al.
9,314,661 B1 4/2016 Chen
10,029,142 B2 * 7/2018 Koenig ..... A63B 21/075
2004/0242385 A1 * 12/2004 Emick ..... A63B 21/0724 482/106
2007/0123398 A1 * 5/2007 Ljevaja ..... A63B 15/00 482/107
2012/0316012 A1 * 12/2012 Thackeray ..... A63B 15/00 473/457
2015/0174445 A1 * 6/2015 Robertson, Jr. .... A63B 23/0405 482/93
2017/0087400 A1 * 3/2017 Chen ..... A63B 21/0628
2017/0157457 A1 * 6/2017 Kurabieski ..... A63B 21/4049
2017/0246495 A1 * 8/2017 Wyncott ..... A63B 21/075

* cited by examiner

USE OF FREE WEIGHTS FOR EXERCISE

BACKROUND

Exercises with weights or resistance are popular for people of all ages. These exercises may occur on "machines" that are purpose-built with complex mechanisms (e.g., pulleys) that attach to a resistance (like weight or elastic, resilient bands). The mechanisms define movements that an individual performs to displace the resistance. While good for novices, however, the mechanisms can make these machines so large and expensive to limit access only to gyms and weight training facilities. The machines also tend to lack dynamism because the rigid, directional design for the movements only directs stress on specific, muscle groups.

Free weights offer an alternative to machine-assisted exercises. This alternative, essentially, requires individuals to directly grasp or handle the resistance, often in the form of weighted devices like dumbbells, kettlebells, or barbells (with weighted plates). Exercises done in this way find favor because the weighted devices are often much less expensive and smaller than any machine. Movements with free-weights are also more effective because individuals must adapt or use more muscle groups to stabilize the weight. This feature appeals to individuals that wish to enhance strength and fitness as well as those that require dynamic effort for sport-specific training. But although beneficial, individuals that use free-weights often need to have certain physical abilities, technical proficiency, or experience to perform movements properly and to avoid injury.

SUMMARY

This disclosure describes improvements in free weight technology to address these issues. Of particular interest are embodiments with an adjustable frame that can secure resistance to a rotatable handle that an individual grasps to manipulate the device. These embodiments operate to displace the resistance relative to the rotatable handle in a way that maintains the weight in its natural gravitational direction. This feature serves to develop and reinforce proper form and technique, which can benefit individuals regardless of experience with free-weights. As a result, individuals can enjoy benefits of free-weights to strengthen primary, secondary, and supportive muscle groups, at much less risk of potential injury.

DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION

Weight training with free-weights provides excellent physical benefits. However, individuals often gravitate toward machine-assisted exercise because they lack experience with free-weights. Individuals with injuries may also prefer machine-assisted exercises because they are unable to appropriately manipulate free-weights or use free-weights for their rehab exercises. And, free-weight enthusiast may simply lose interest in exercise altogether because free-weight movements become particularly tedious or monotonous.

The discussion below describes embodiments of an apparatus that makes training with free-weights more accessible and enjoyable for individuals at all levels of experience and physical abilities. This apparatus is configured to synthesize exercises done on machines or that use free-weights. These configurations can familiarize novices with free-weight exercises. Likewise, these configurations can adapt for use in exercise that rehabs prior injuries. The configurations can also provide a platform for experienced individuals to experiment or augment free-weight movements. This feature can allow individuals to perform exercises of better variety or develop movements that hit a "sweet spot" to better target muscle development and avoid plateaus that often lead to disinterest in an exercise regime. Other embodiments are within the scope of the subject matter herein.

Figure 1:
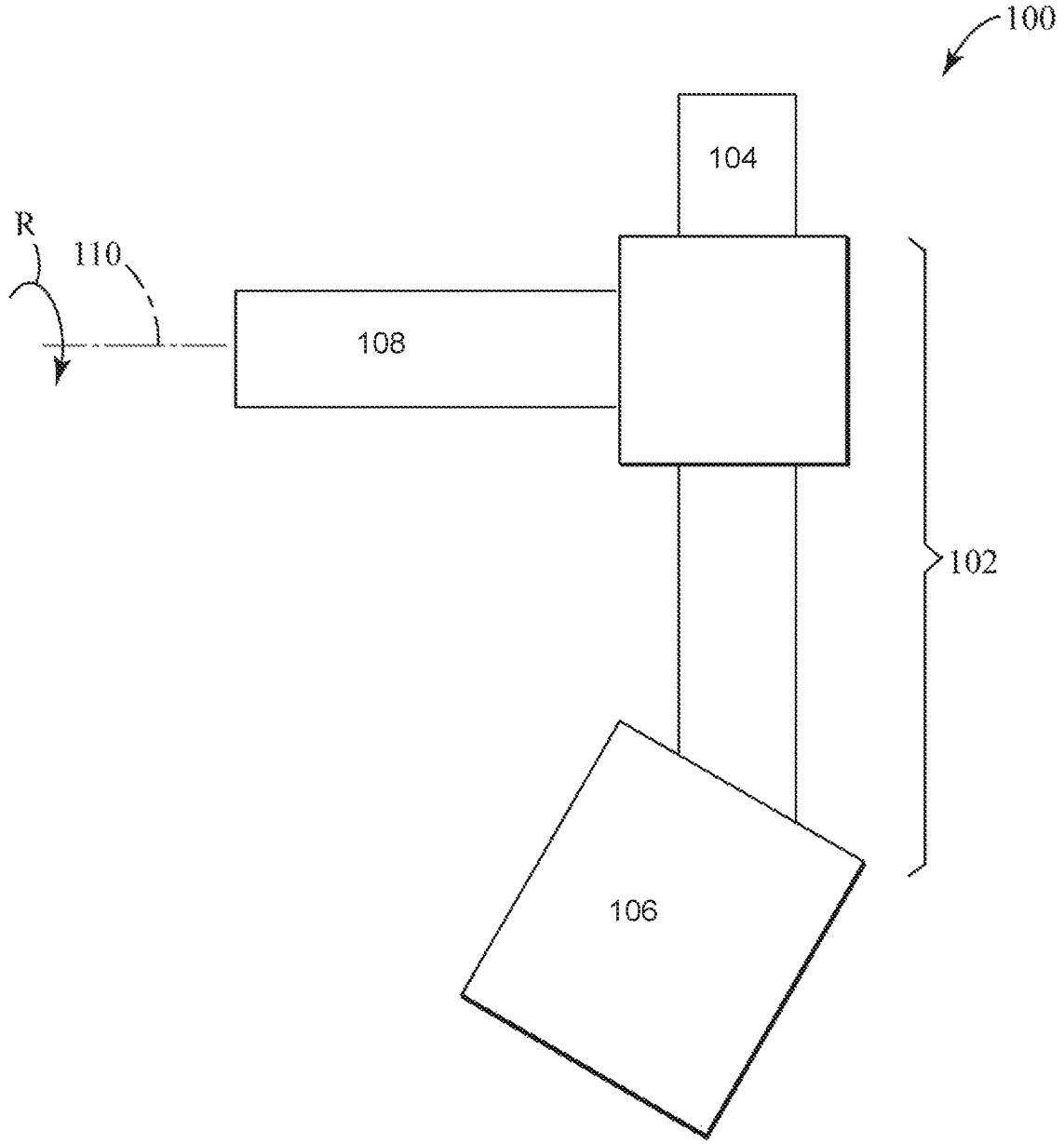
FIG. 1 depicts a schematic diagram of an exemplary embodiment of a weight training apparatus.

FIG. 1 depicts a schematic diagram of an exemplary embodiment of an exercise apparatus 100. This embodiment may include a frame 102 that receives one or more weight retaining units (e.g., a first unit 104 and a second unit 106). The units 104, 106 may be configured to retain resistance, like a barbell shaft that secures to the first unit 104 or weight plates that secure to the second unit 106. The frame 102 may also receive a handle 108 that can rotate about an axis 110, as indicated by the arrow R.

Figure 2:
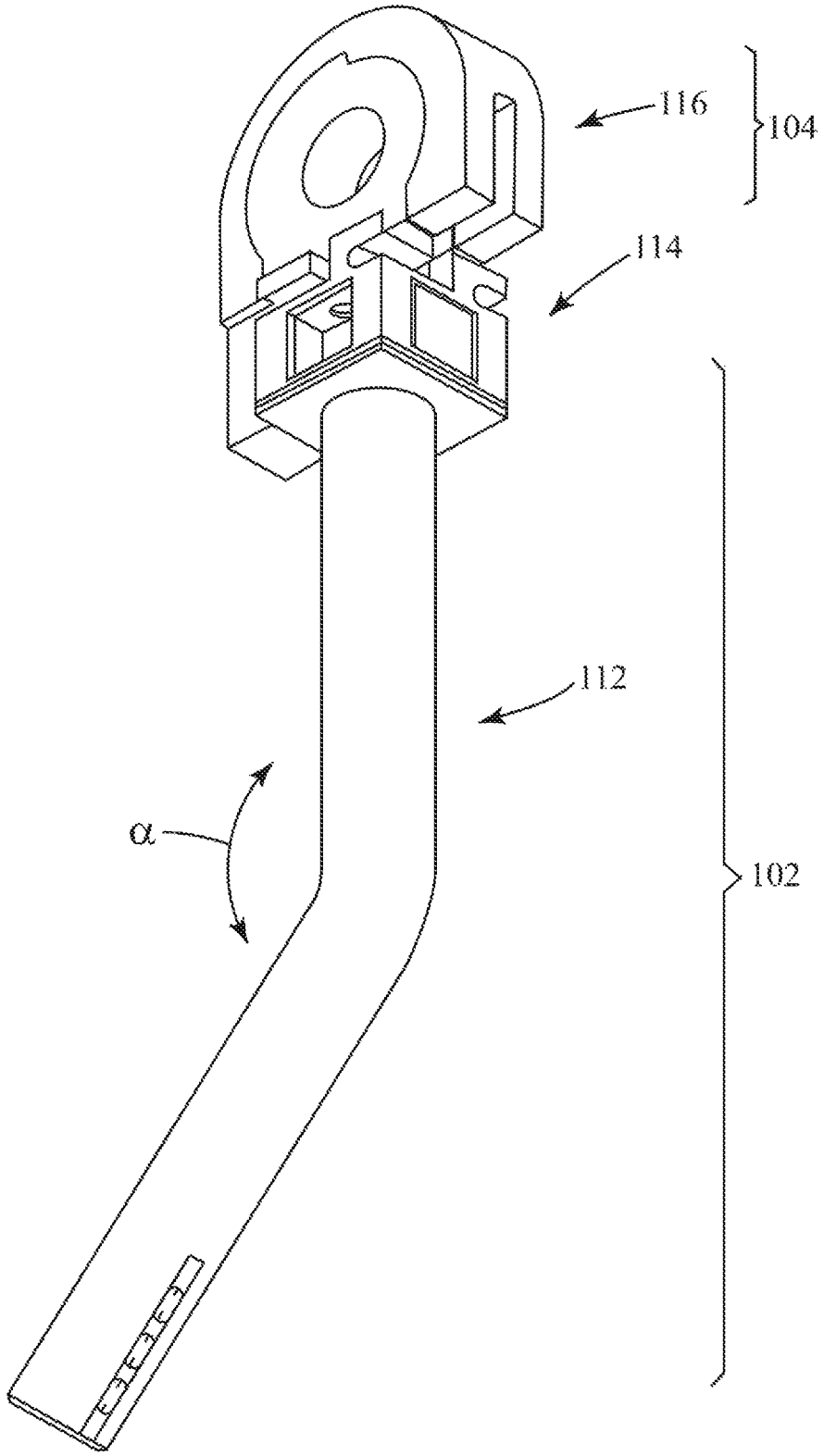
FIG. 2 depicts a perspective view of exemplary structure for the weight training apparatus of FIG. 1.
Figure 3:
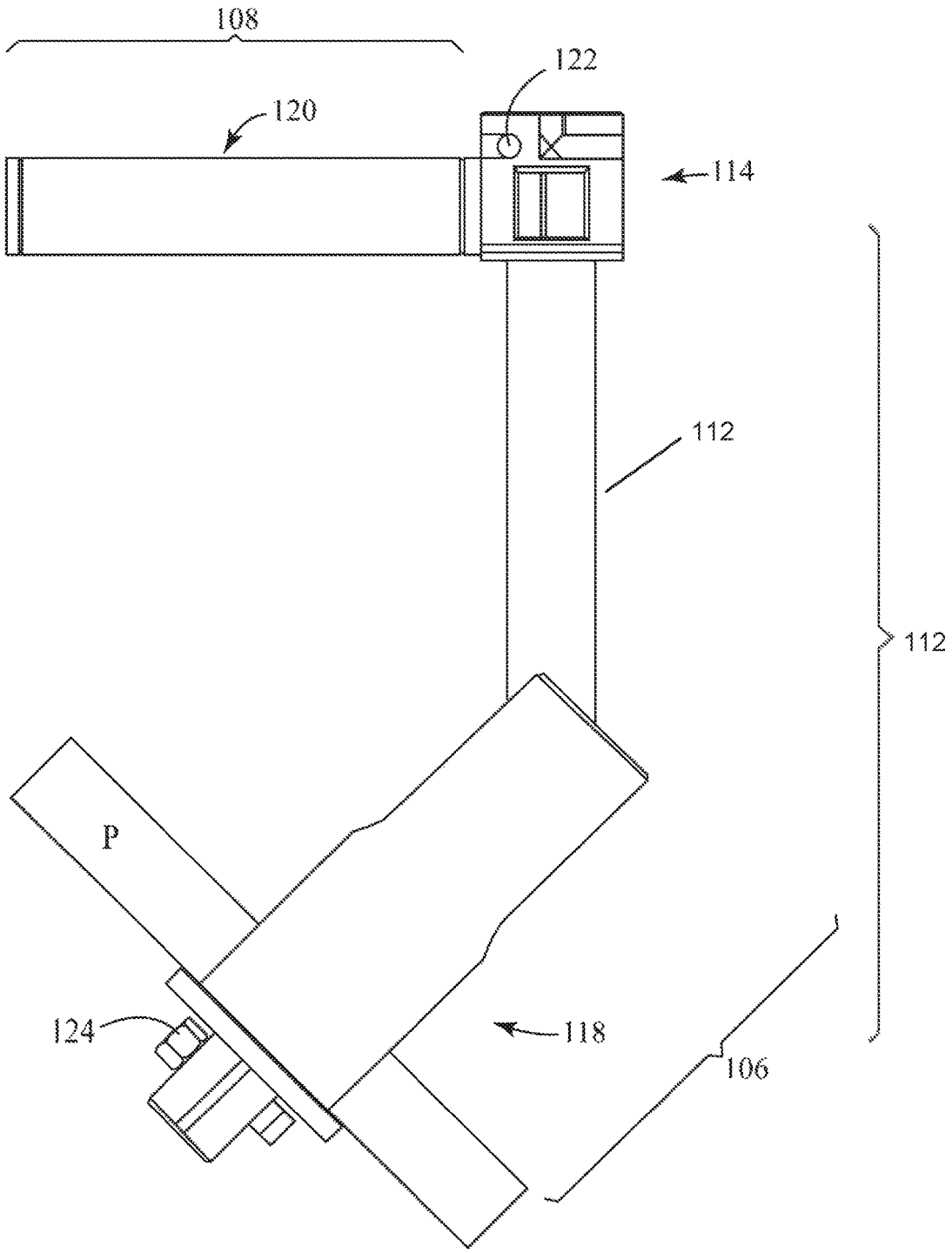
FIG. 3 depicts a perspective view of exemplary structure for the weight training apparatus of FIG. 1.

FIGS. 2 and 3 depict exemplary structure for the assembly 100 of FIG. 1. Generally, structure for the assembly 100 allows individuals to mix and match parts, for example, the units 104, 106 and the handle 108. This feature results in different configurations that serve different types of exercises. In FIG. 2, the frame 102 may comprise a tubular structure 112 that is bent at an angle α. Values for this angle may facilitate the dynamic distribution and pathing of resistance (e.g., weights) that attach to the tubular structure 112. As shown, these values may be less than 180°, or in a range of from about 90° to about 180°. An adapter 114 may reside on one end of the tubular structure 112. The adapter 114 can accommodate the first unit 104, which may operate as a barbell retainer 116 to secure the tubular structure 112 to a shaft or bar. As best shown in FIG. 3, the barbell retainer 116 (FIG. 2) may remove from the assembly 100 in lieu of only the second unit 106, shown here as a plate retainer 118 that can hold and retain one or more weight plates P on the tubular structure 112. This configuration may require use of the handle 108 that may embody an elongate cylindrical member 120. In one implementation, the apparatus 100 may leverage one or more keys (e.g. a first key 122 and a second key 124) to releasably secure the plate retainer 118 for the barbell retainer 116 (FIG. 2) and the cylindrical member 120 in position on the apparatus 100. The first key 122 may extend through the adapter 114 and the cylindrical member 120 (or the barbell retainer 116 (FIG. 2) to secure or "lock" them in position on the adapter 114. The second key 124 may insert into the tubular structure 112. It may benefit the design for the second key 124 to reside to one side of the plate retainer 118 to locate the plate retainer 118 on the frame 102. Keys 122, 124 can releasable engage from the tubular structure 112 and the adapter 114 to allow changes to the device for example, to add or remove the plate retainer 118 (or the barbell retainer 116 (FIG. 2)) or the handle 108, to move or relocate the barbell retainer 116 (FIG. 2) or the cylindrical member 120 on the adapter 114, to re-locate the plate retainer 118 on the tubular structure 112, or to change the number of plate weights P.

Figure 4:
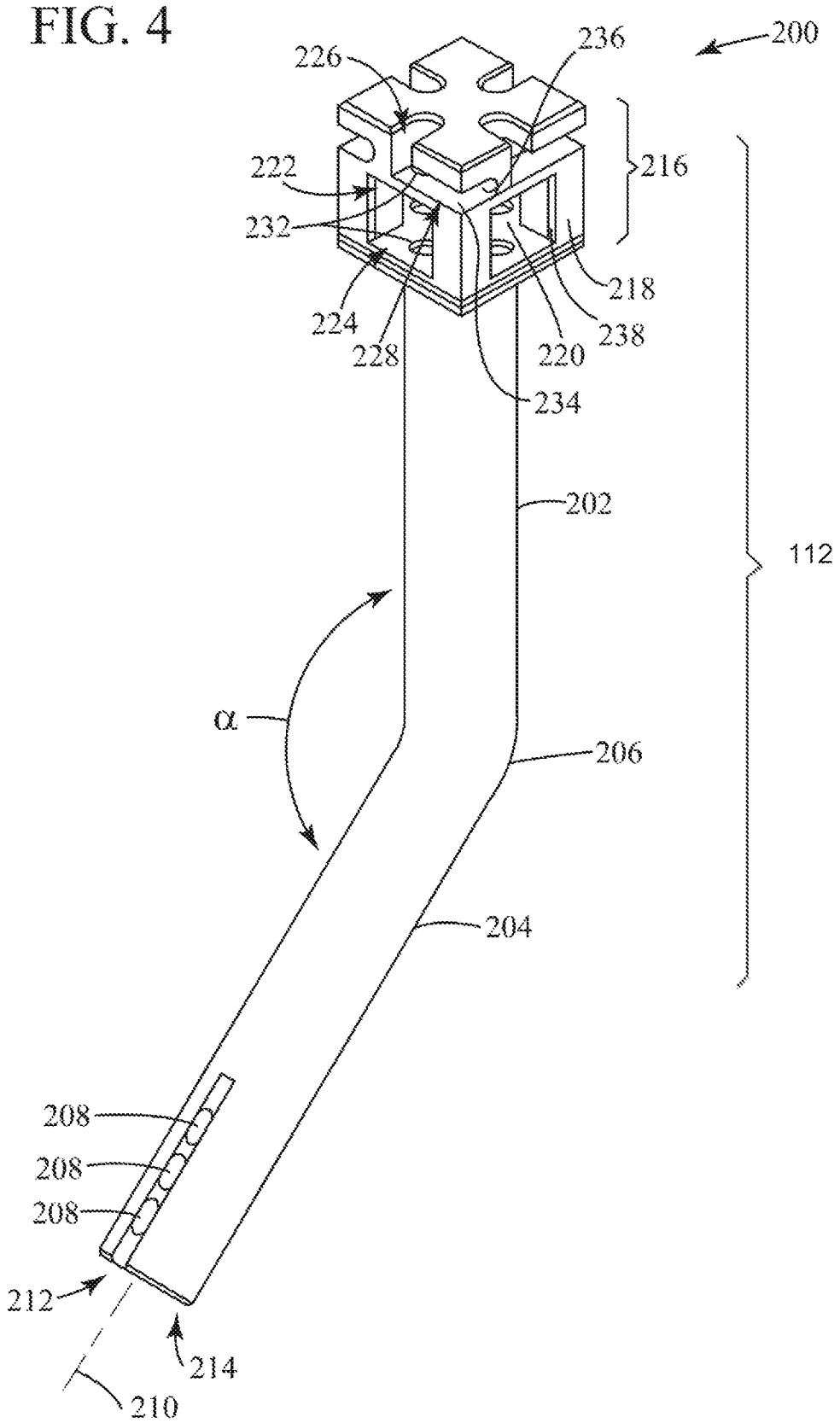
FIG. 4 depicts a perspective view of one construction for a frame for use in the weight training apparatus of FIGS. 2 and 3.

FIG. 4 depicts a perspective view of the tubular structure 112 for use in the apparatus 100 of FIG. 1. The tubular structure 112 may leverage a construction 200 for the adapter 114 (FIG. 3) in combination with a pair of members (e.g., a first tube member 202 and a second tube member 204). The members 202, 204 may each have an elongate body, for example, solid or hollow tubes made of metal like steel, stainless steel, or aluminum. The tubes 202, 204 may attach together at a joint 206, itself configured to arrange the tubes 202, 204 relative to one another at the angle .alpha.. The joint 206 may serve to unify the tubes 202, 204, for example, as if formed monolithically by bending a single piece to the angle .alpha. or welding two individual pieces together. The second tube 204 may include one or more apertures 208 that penetrate through the material. The apertures 208 may be spaced apart from one another longitudinally and align on an axis 210. In one implementation, the apertures 208 may reside in a primary slot 212, shown here to extend longitudinally from the end of the second tube 204 towards the joint 206. The device may also benefit from one or more secondary slots 214 that populate the periphery of the second tube 204. The first tube 202 may support an adapter body 216 with peripheral walls 218 and a hollow interior 220. Geometry for the adapter body 216 may be "cubic," as shown; however other geometry (e.g., rectangular, spherical, etc.) may prevail as well. This geometry may result from machining a single block or "billet" of material, although other techniques like casting may work to form its structure as well. These techniques may form various other features, shown here as channels 222 and openings 224. In one implementation, the channels 222 form a slot in the adapter body 216. Each slot may comprise a pair of passages (e.g., a first passage 226 and a second passage 228), one each that extends from a "top" of the body 216 and from a "side" of the body 216, respectively. Together the passages 226, 228 may form an elongate opening 230 in the side. Geometry for the elongate opening may be L-shaped, particularly where the passages 226, 228 transit the adapter body 216 perpendicular to one another. Holes 232 may penetrate the second passage 228 (and the "bottom" of the adapter body 216). As shown, the passages 226, 228 may have a cross-section with parallel elongate sides 234 that terminate in a rounded or semi-annular bottom 236. The openings 224 may reside exclusively on the sides of the adapter body 216, penetrating through the peripheral walls 218, for example, to form or expose the hollow interior 220. The openings 224 may have a form factor set to receive the barbell retainer 116 or the cylindrical member 120. The form factor may be square, as shown, but other form factors like rectangles and circles (annular) may be useful for this purpose. Edges of the openings 224 and the passages 226, 228 may include a chamfer 238 that operates to guide these parts into engagement with the adapter body 216. The first key 122 may insert into the elongate opening 230, extending through holes 232 and corresponding parts of the barbell retainer 116 or the cylindrical member 120.

Figure 5:
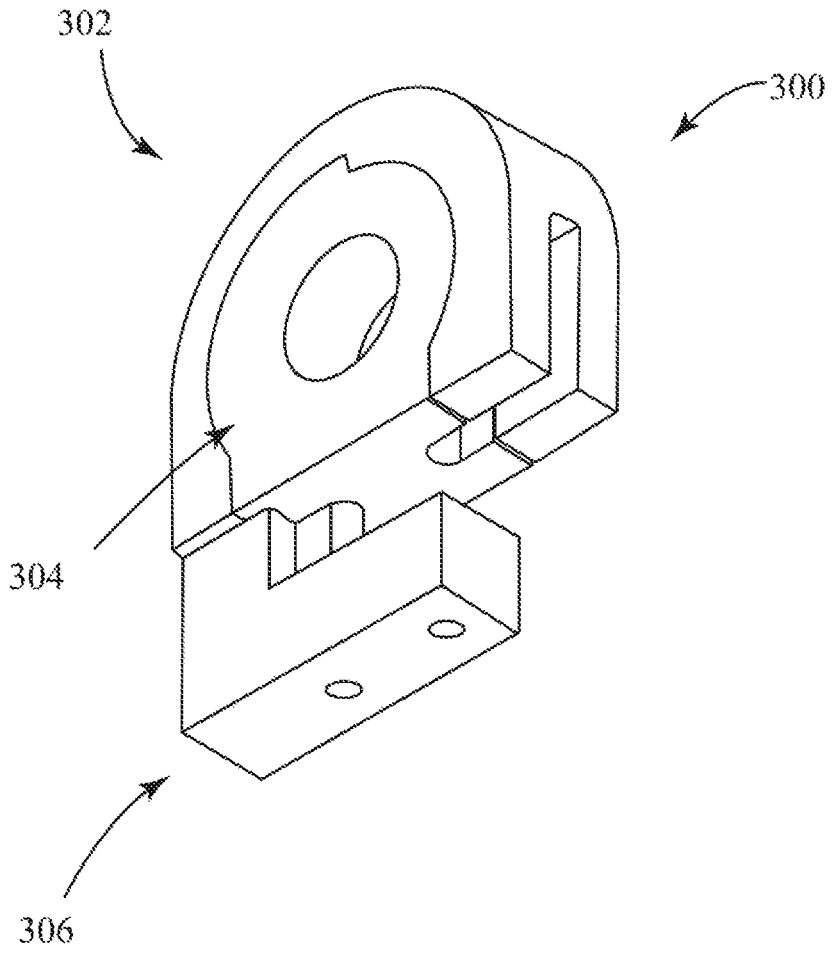
FIG. 5 depicts a perspective view of one construction for a barbell retainer for use in the weight training apparatus of FIGS. 2 and 3.
Figure 6:
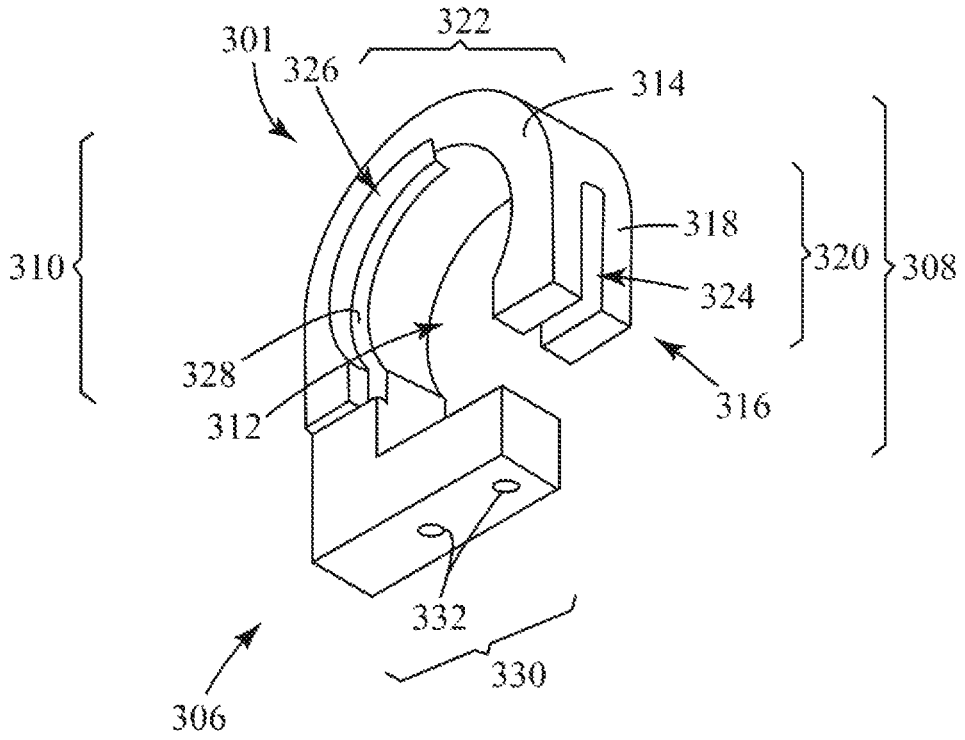
FIG. 6 depicts a perspective view of a part of the construction of FIG. 5.
Figure 7:
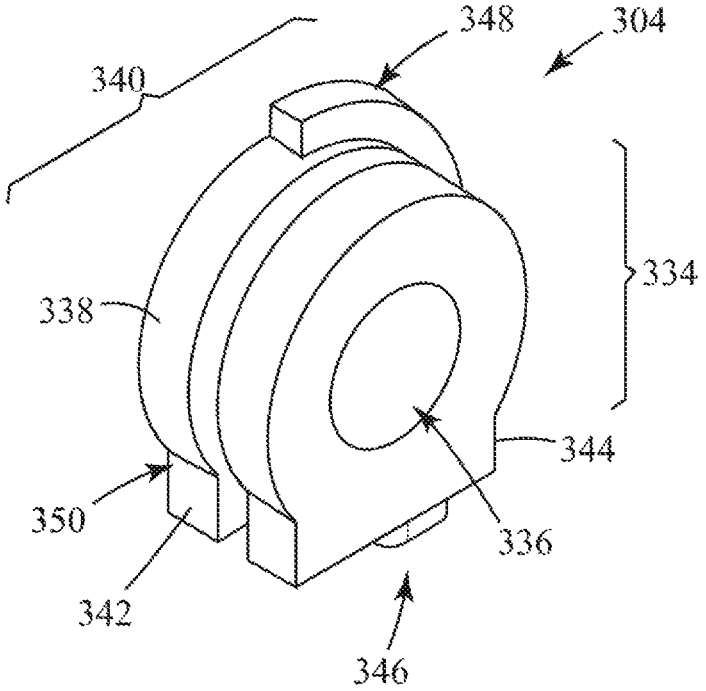
FIG. 7 depicts a perspective view of a part of the construction of FIG. 5.

FIGS. 5, 6, and 7 depict exemplary construction 300 for the barbell retainer 116 (FIG. 2). The construction 300 may form a multi-piece design with an outer housing 302 and an inner weight retainer 304 that fits, at least partially, inside of the outer housing 302. The structure 300 may also include an interface member 306 that may be formed to insert into the adapter body 216.

As best shown in FIG. 6, the outer housing 302 and interface member 306 may be formed integrally as a single, unitary or monolithic body 308. Examples of the body 308 may include an upper part 310 with a central opening 312 to receive the weight retainer 304. The upper part 310 may also have opposite side surfaces (e.g., a first surface 314 and a second surface 316) and an outer surface 318 with a generally flat or planar region 320 that turns into a generally annular region 322. A slot 324 may penetrate at the planar region 320 to the central opening 310. At the annular region 322, an elongated detent region 326 may penetrate into the first surface 312, preferably proximate the central opening 312 to reduce the thickness of the body 308 as measured from the second surface 316 to a bottom 328 of the detent region 326. The interface member 306 may locate proximate the detent region 326, forming an L-shaped bracket 330 with openings 332 disposed therein. The L-shaped bracket 330 can be configured to insert into the openings 224 on the adapter body 216. When in position, this configuration aligns with holes 224 in the adapter body 216 to allow the first key 122 to extend through one of the openings 332 and lock the barbell retainer 116 for use on the apparatus 100.

FIG. 7 shows an example of the barbell retainer 304. This example includes a retaining body 334 with a central bore 336 that is sized to receive, for example, a handgrip of a barbell or dumbbell. The body 334 also has an outer surface 338 with an annular region 340 that extends between a pair of opposing planar regions (e.g., a first planar region 342 and a second planar region 344). The body 334 may include a boss 346 that extends from the bottom. The boss 346 is shown here disposed proximate the second planar region 344, but other locations are may also suffice. The body 334 may also include an annular protrusion 348 and an annular slot 350 that correspond with the annular region 340 of the outer surface 338. In use, the central bore 336 has a diameter configured to receive standard barbell shaft, which typically have standard dimensions. The annular portion for the protrusion 348 fits into the elongated detent region 326 so that the weight retainer 304 can assemble into outer housing 302 (as shown in FIG. 5). In this orientation, the annular slot 350 aligns with the slot 324 of the outer housing 302.

Figure 8:
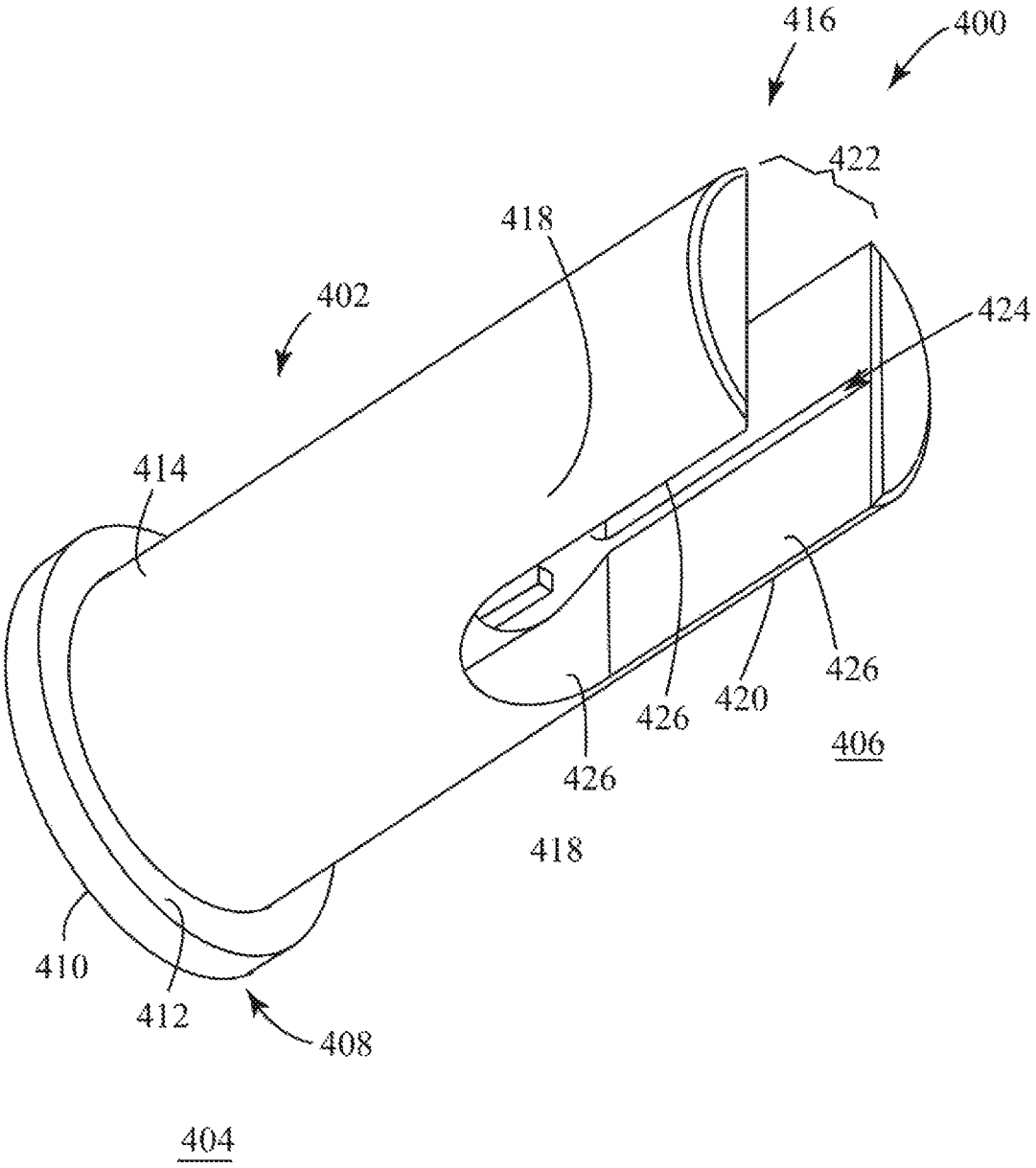
FIG. 8 depicts a perspective view of one construction for a plate retainer for use in the weight training apparatus of FIGS. 2 and 3.
Figure 9:
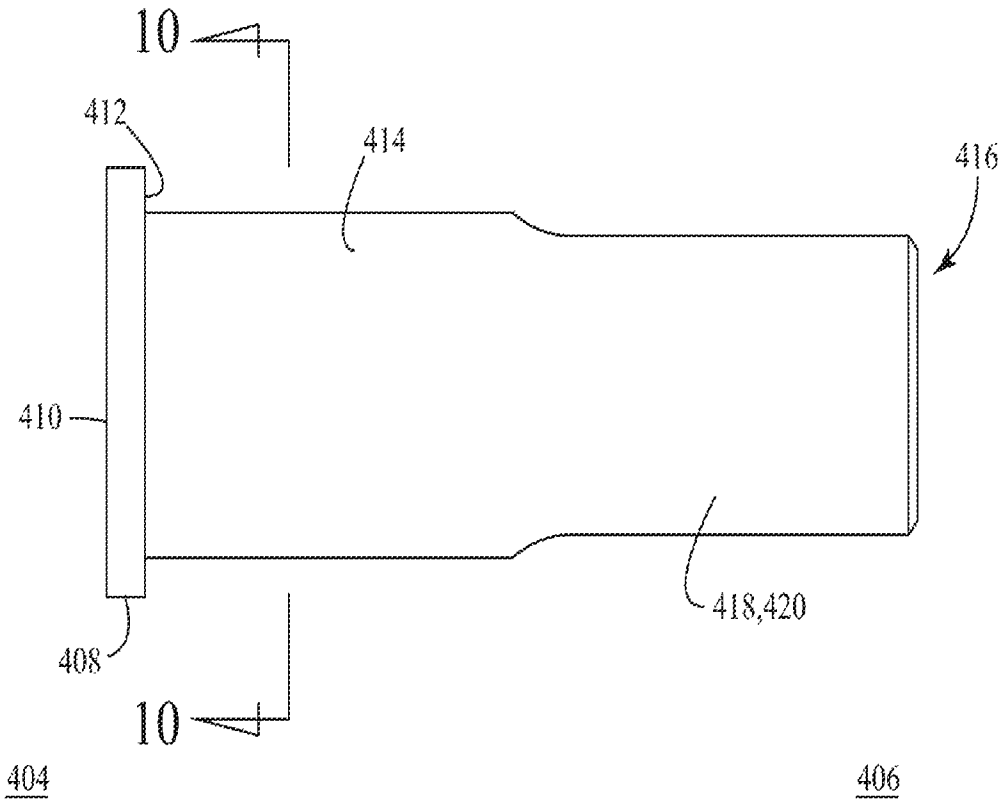
FIG. 9 depicts an elevation view from the side of the construction of FIG. 8.
Figure 10:
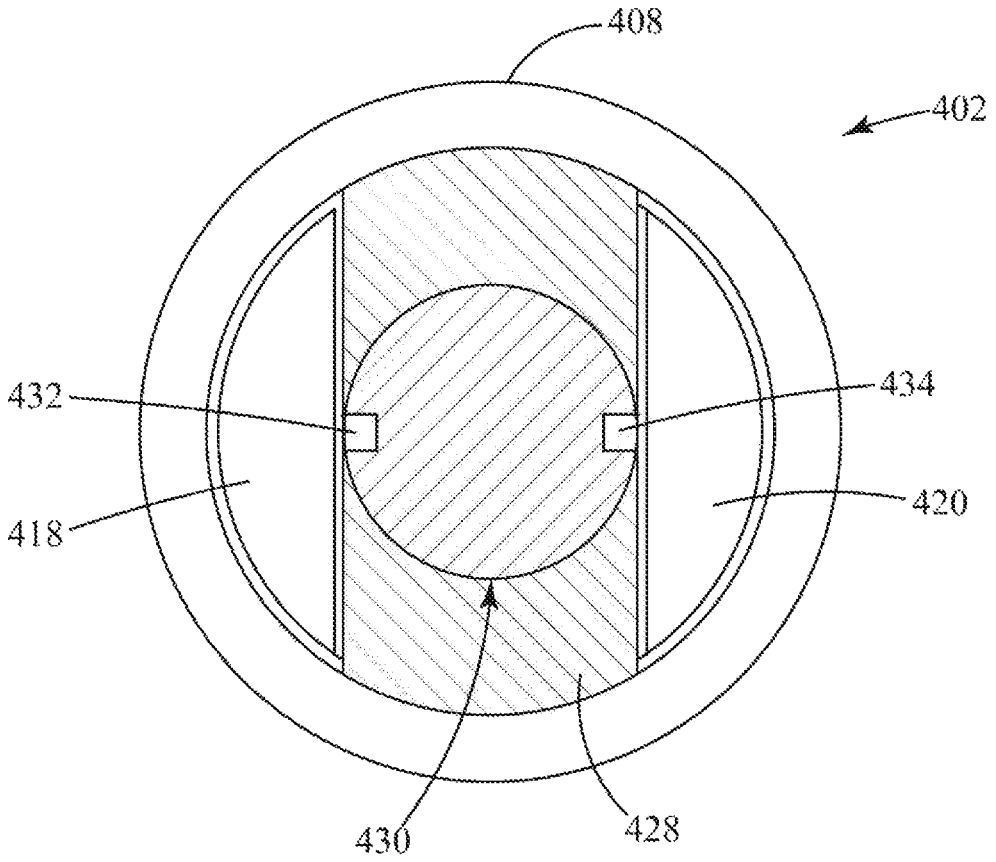
FIG. 10 depicts an elevation view of the cross-section of FIG. 9.

FIGS. 8, 9, and 10 depict an exemplary construction 400 for the plate retainer 118 (FIG. D. The construction 400 affords efficient design to allow an exerciser convenient transition between various exercise movements without the need for unwanted downtime. For some embodiments, the axis of the structure 400 may align with the axis on second tube 204 (FIG. 4). But other examples may configure the axis offset, at an angle, or otherwise displaced relative to this axis as well.

FIG. 8 depicts a perspective view. The construction 400 may feature a generally annular body 402 with a flange end 404 and a yolk end 406. On the flange end 404, the body 402 forms a shoulder 408 with opposing surfaces 410, 412. The surface 412 terminates at a reduced diameter portion 414 that extends longitudinally from the shoulder 408 to terminate at a prepared end 416, possibly with a chamfer or like feature. As shown, the reduced diameter portion 414 may form a pair of yolk members (e.g., a first yolk member 418 and a second yolk end 420). The members 418, 420 are spaced apart from one another by a gap 422. Sizes for the gap 422 are preferably sufficient to fit around the second tube 204 (FIG. 4). In one implementation, the gap 422 spans a recess 424 in the reduced diameter portion 414. The recess 424 may form parallel side walls 426 in each of the yolk members 418, 420. The side walls 426 may give way to a rounded or arcuate bottom surface 428.

FIG. 9 depicts an elevation view from the side. The reduced diameter portion 414 of the body 402 may neck-down from the flange end 404 to the yolk end 406. This feature reduces the diameter of the body 402 further at the yolk members 418, 420. Generally, the diameter is sized to receive plate weights, which often come with a pre-sized hole of standard configuration. Reductions in the diameter may allow the individual to more easily insert the yolk end 406 into this pre-sized hole. The chamfered end 416 may smooth the transition for plate weights.

FIG. 10 depicts an elevation view of the cross-section of FIG. 9. The body 402 may include a bore 430 that extends from the bottom surface 428 through the flange end 404. One or more protrusions (e.g., first protrusion 432 and second protrusion 434) may reside in the bore 430. The protrusions 432, 434 may be annular separated by 180°, as shown; but this disclosure contemplates other configurations, for example, that match the slots 214 on the second tube 202. In use, the protrusions 432, 434 can engage with complimentary slots 214 on the second tube 202 108 to allow the body 402 and plate weights P to slide onto and longitudinally translate toward the joint 206.

Figure 11:
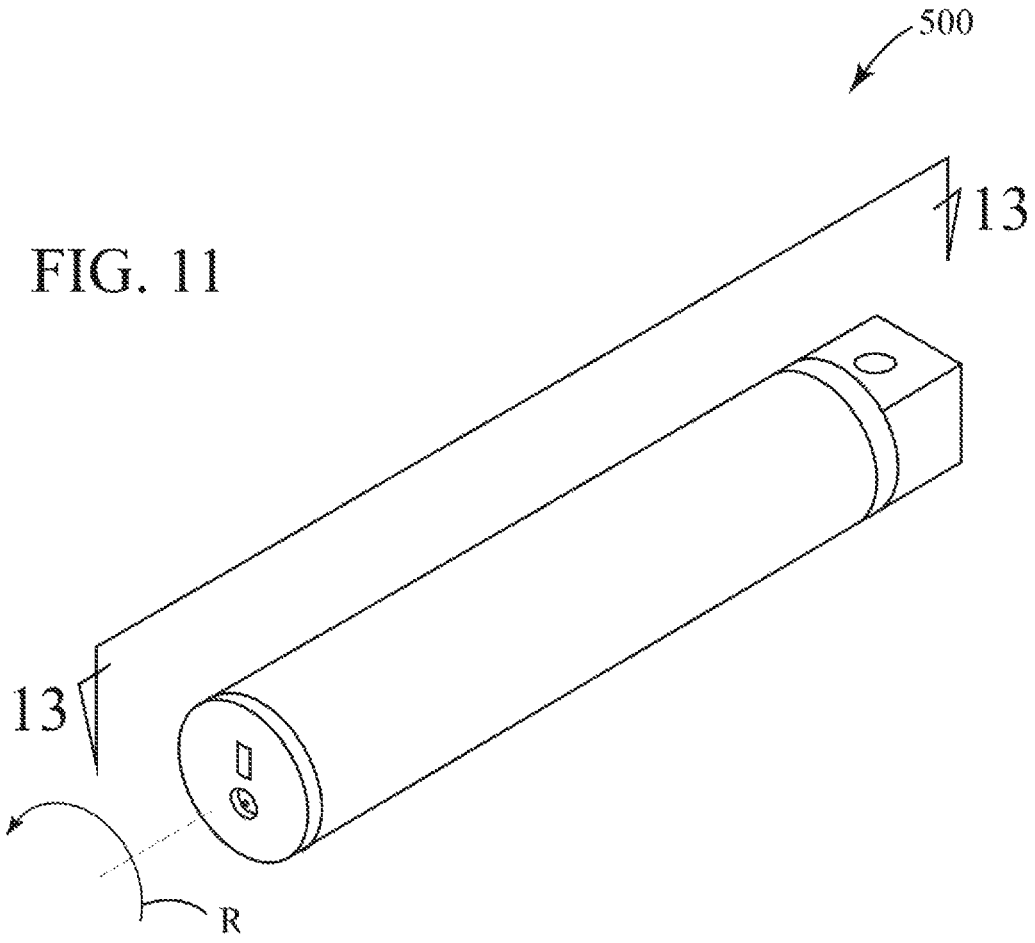
FIG. 11 depicts a perspective view of one construction for a handle for use in the weight training apparatus of FIGS. 2 and 3.
Figure 12:
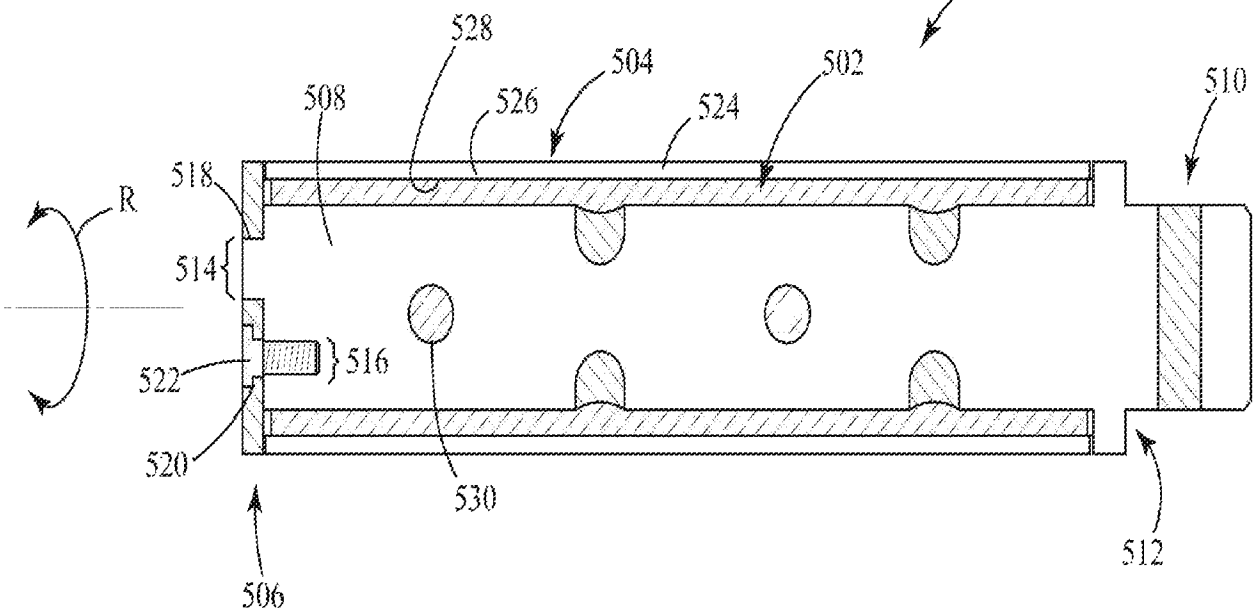
FIG. 12 depicts an elevation view of the cross-section of FIG. 11.

FIGS. 11 and 12 shows an exemplary construction 500 for the handle 108 (FIG. 3). In this example, the construction 500 utilizes multiple pieces to facilitate rotation R, including a pair of members (e.g., an inner or first member 502 and an outer or second member 504). At one end, the construction 500 may include an end cap 506. The inner member 502 may comprise a solid, cylindrical core 508, preferably made of metal as well. One end of the cylindrical core 508 may have a through hole 510, which can be sized accordingly to receive the first key 122. A shoulder 512 may be spaced distally-way from the through hole 510. At the other end, the cylindrical core 508 may have features to mount the end cap 506. These features may include a boss 514 that extends from the end and a threaded hole 516. The end cap 506 may include an aperture 518 to receive the boss 514, which is effective to "clock" the position of the end cap 506 relative to the cylindrical core 508. A second aperture 520 may form a counter-bored hole that is useful to receive a fastener 522 that engages with the threaded hole 516 and secures the end cap 506 to the core 508. This encloses the second member 504, between the end cap 506 and the shoulder 512. The second member 504 may embody a hollow, metal tube 524 that circumscribes the core 508. The hollow tube 524 may have an outer surface 526 that is knurled or otherwise exhibits texturing to improve grip of the end user. Its inner surface 528 may be spaced part from the core 508, which is effective to allow the tube 524 to move independent of the core 508. In one implementation, the core 508 may include one or more detents 530. These features may form spherical pockets in the material of this part. When assembled, ball bearings or other standoffs may populate the detents 530 to form a gap that separates the hollow tube 524 and the core 508. The gap can permit movement of the tube 524 relative to the core 508 to allow rotation R as noted above. Rotation serves to guide the pathing of weight plates P in a manner consistent with the dynamic adaptive and supportive function of the apparatus 100.

Figure 13:
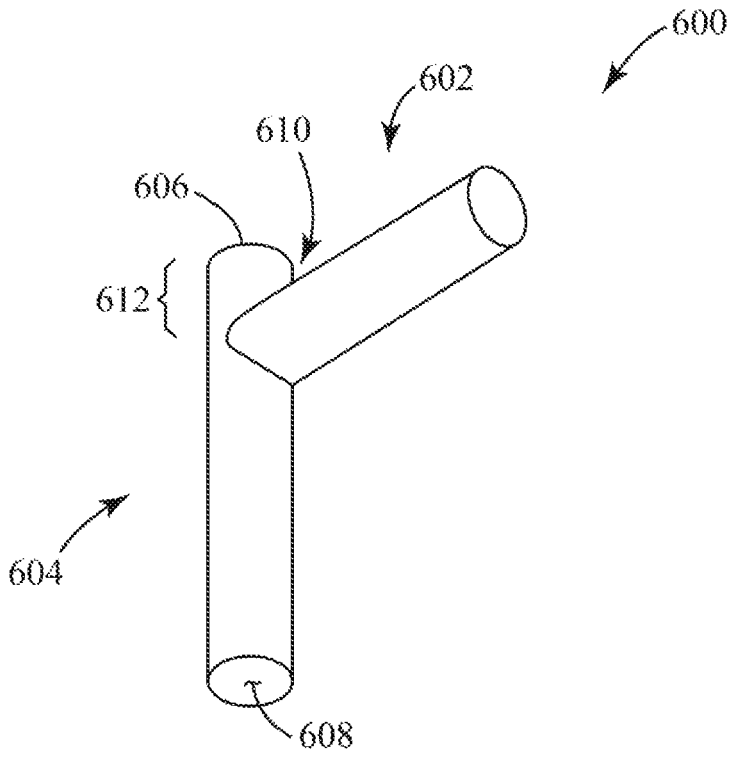
FIG. 13 depicts a perspective view of one construction for a key for use in the weight training apparatus of FIGS. 2 and 3.

FIG. 13 shows a perspective view of an example of structure 600 for the first key member 122 (FIG. 3). Here, the structure 600 may include a tubular design that features a pair tubular, or cylindrical members (e.g., a first cylindrical member 602 and a second cylindrical member 604). The second cylindrical member 604 may have ends (e.g., a first end 606 and a second end 608). In one implementation, the first cylindrical member 602 couples with the second cylindrical member 604 at a joint 610, which is set off or offset from the first end 606 to create a protruding portion 612 of the second cylindrical member 604. Generally, the joint 610 may be welded, although fasteners may penetrate through the members 602, 604 to make appropriate connection. As noted above, diameters of the members 602, 604 are sized to fit into holes in the adapter body 216.

Figure 14:
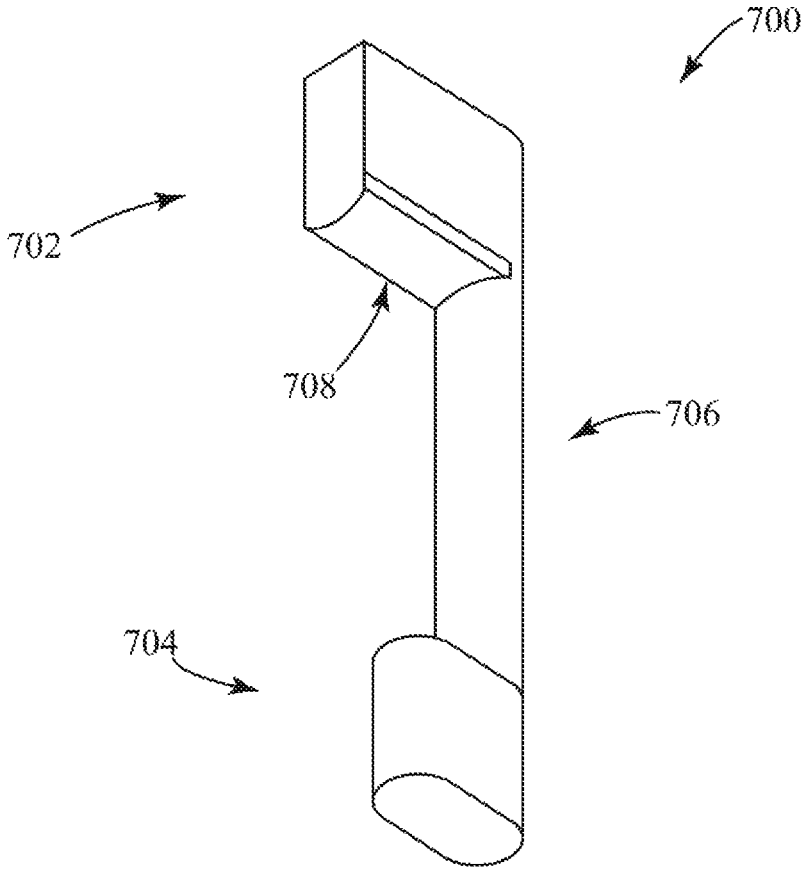
FIG. 14 depicts a perspective view of one construction for a key for use in the weight training apparatus of FIGS. 2 and 3.

FIG. 14 shows a perspective view of an example of structure 700 for the second key member 124 (FIG. 3). The structure 700 may include a top piece 702, a bottom piece 704, and an intermediate piece 706 extending therebetween. In use, the structure 700 is fashioned to insert into apertures 208 of the second tube 202. Preference may provide curvature 708 on the underside of the top piece 702 with dimensions (e.g., radius) to correspond with curvature of the primary slow 212 of the second tube 204.

In view of the foregoing, the embodiments are versatile to adapt to different forms of resistance and variations in exercises. These features offer valuable adjustments to accommodate individuals of all levels of skill and interest in weight training.

This written description uses examples to disclose the invention, including the best mode, and also to enable any person skilled in the art to practice the invention, including making and using any devices or systems and performing any incorporated methods. An element or function recited in the singular and proceeded with the word "a" or "an" should be understood as not excluding plural said elements or functions, unless such exclusion is explicitly recited. References to "one embodiment" of the claimed invention should not be interpreted as excluding the existence of additional embodiments that also incorporate the recited features. Furthermore, the claims are but some examples that define the patentable scope of the invention. This scope may include and contemplate other examples that occur to those skilled in the art. Such other examples are intended to be within the scope of the claims if they have structural elements that do not differ from the literal language of the claims, or if they include equivalent structural elements with insubstantial differences from the literal language of the claims.

Examples appear below that include certain elements or clauses one or more of which may be combined with other elements and clauses describe embodiments contemplated within the scope and spirit of this disclosure.

What is claimed is:

1. A weight training system, comprising:

a bent shaft having a first end and a second end;

an adapter disposed on the first end of the bent shaft;

a first retainer having a portion insertable into the adapter, the first retainer having a central opening set apart from the bent shaft;

a handle having a portion insertable into the adapter, the handle rotatable relative to the bent shaft;

a second retainer with an aperture to receive the second end of the bent shaft; and a plurality of keys comprising a first key and a second key, wherein the first key is insertable into the adapter to set a position of either or both of the first retainer and the handle, wherein the second key is insertable into the bent shaft to set a position of the second retainer, and wherein the handle comprises an inner core and an outer sleeve rotatable relative to the inner core.

2. The weight training system of claim 1, wherein the inner core comprises the portion of the handle insertable into the adapter and the inner core remains affixed relative to the bent shaft.

3. The weight training system of claim 1, further comprising:

ball bearings disposed between the inner core and the outer sleeve.

4. The weight training system of claim 1, wherein the first key fits into the inner core to retain the portion of the handle insertable into the adapter.

5. The weight training system of claim 1, wherein the first retainer comprises:

an outer housing that forms the portion of the first retainer insertable into the adapter; and an inner weight retainer that removeably inserts into the outer housing and forms the central opening.

6. The weight training system of claim 1, wherein the bent shaft comprises a plurality of openings aligned on an axis proximate the second end so as to receive the second key.

7. The weight training system of claim 1, wherein the adapter is cubic with openings that penetrate through opposing faces thereof and form an axis that is perpendicular to the bent shaft.

8. The weight training system of claim 1, wherein the bent shaft forms an angle of less than 180°.

9. The weight training system of claim 1, wherein the bent shaft forms an angle in a range between about 90° and 180°.

10. The weight training system of claim 1, wherein the bent shaft has separate members that connect at a joint.

11. The weight training system of claim 1, wherein the adapter can receive the handle on more than one side.

12. The weight training system of claim 1, wherein the second retainer comprises a cylindrical body with a shoulder disposed on one end.

13. The weight training system of claim 1, wherein the second retainer comprises a cylindrical body with a diameter that is larger than a diameter of the bent shaft.

14. A weight training system, comprising:

a bent shaft having a first end and a second end;

an adapter disposed on the first end of the bent shaft;

a first retainer having a portion insertable into the adapter, the first retainer having a central opening set apart from the bent shaft;

a handle having a portion insertable into the adapter, the handle rotatable relative to the bent shaft;

a second retainer with an aperture to receive the second end of the bent shaft; and a plurality of keys comprising a first key and a second key, wherein the first key is insertable into the adapter to set a position of either or both of the first retainer and the handle, wherein the second key is insertable into the bent shaft to set a position of the second retainer, and wherein the first retainer comprises an L-shaped bracket that forms the portion of the first retainer insertable into the adapter, and wherein the first key fits into the L-shaped bracket to prevent relative movement between the first retainer and the bent shaft.

15. The weight training system of claim 14, wherein first retainer comprises a multi-piece design.

16. The weight training system of claim 14, wherein the first retainer comprises a first piece and a second piece that nests inside of the first piece, wherein the L-shaped bracket is disposed on the first piece.

17. The weight training system of claim 14, wherein the second retainer comprises a cylindrical body with a shoulder on one end.

18. The weight training system of claim 14, wherein the second retainer comprises a cylindrical body with a diameter that is larger than a diameter of the bent shaft.

19. The weight training system of claim 14, wherein the bent shaft comprise two pieces coupled at a joint.

20. The weight training system of claim 14, wherein the handle comprises two pieces, one of which rotates independent of the other.

* * * * *